US005443086A

United States Patent [19]

Muller

[11] Patent Number: 5,443,086

[45] Date of Patent: Aug. 22, 1995

[54] UMBRELLA COVER ASSEMBLY

[76] Inventor: John J. Muller, 720 Mountain Rd., West Hartford, Conn. 06117

[21] Appl. No.: 191,661

[22] Filed: Feb. 4, 1994

[51] Int. Cl.[6] ..... A45B 15/00

[52] U.S. Cl. ..... 135/34.2; 224/915; 150/154

[58] Field of Search ..... 135/34.2, 15.1, 16; 224/915; 150/154, 158

[56] References Cited

U.S. PATENT DOCUMENTS

| | | | |
|---|---|---|---|
| 1,381,043 | 6/1921 | Weinberg et al. | 135/34.2 |
| 2,190,264 | 2/1940 | Goldstein | 135/34.2 |
| 3,490,469 | 1/1970 | Dubinsky | 135/34.2 |
| 4,062,370 | 12/1977 | Brickner et al. | 135/34.2 |

FOREIGN PATENT DOCUMENTS

| | | | |
|---|---|---|---|
| 0376153 | 7/1990 | European Pat. Off. | 224/915 |
| 8202999 | 9/1982 | WIPO | 135/34.2 |

*Primary Examiner*—Lanna Mai

*Attorney, Agent, or Firm*—McCormick, Paulding & Huber

[57] ABSTRACT

An umbrella cover assembly includes a truncated conical cover made from felxible water repellent material and closed at its upper end has a longitudinal slit extend from its open lower end toward its upper end. Elongate battens made from resilient flexible material and having arcuate transverse cross-sections are contained within pockets in the cover extending along opposite sides of the slit. The battens impart longitudinal stiffness to the flexible cover in the region of the slit and are used to raise the cover to position it on a tall article. Both the cover and the battens contained in it are foldable to a compact storage condition.

21 Claims, 2 Drawing Sheets

UMBRELLA COVER ASSEMBLY

BACKGROUND OF THE INVENTION

This invention relates in general to covers for vertically elongate articles and deals more particularly with an improved protective cover assembly for a garden or patio umbrella of foldable type.

The present invention is particularly concerned with the type of umbrella used to shade a patio table and which is usually supported by the table. The upper end of such an umbrella may be eight feet or more above ground level, which poses a problem in positioning a protective cover on the umbrella in its folded or collapsed condition to protect the umbrella when not in use.

Heretofore, various types of rain and storage covers have been provided for use with umbrellas of the aforesaid type. One such cover shown in U.S. Pat. No. 3,490,469 to Dubinsky is concerned with the aforedescribed positioning problem. The umbrella cover shown in the Dubinsky patent comprises a tapered sleeve made from flexible sheet material and diverging downwardly from a peak to an open lower end. The cover has a slit along one side which extends upwardly from the lower end and terminates some distance below the peak. A rigid rod received within a pocket formed in the cover extends along one side of the slit and is used to elevate the flexible cover and place it in an umbrella receiving position wherein the upper end of the slit is above the upper end of the umbrella and the cover is in vertical alignment with the umbrella so that the cover may then be drawn down over the umbrella. As taught by Dubinsky the operation is generally reversed to remove the cover from the umbrella.

Although the structure disclosed in the aforedescribed patent solves the problem of positioning a cover on and removing it from a tall umbrella a further problem remains in storing the cover when it is not in use. The rigid rod required to elevate the cover must be three to four feet in length. Consequently, when the cover is in its assembled condition with the rod in it the cover cannot be folded to a convenient size for storage. A convenient nearby location may not be available for storing the cover in its assembled condition with the rod in it. Removal of the rod from the cover is troublesome and requires that the rod be stored separately from the cover and reinstalled in the cover the next time the cover is used.

Accordingly, it is the general aim of the present invention to provide an improved unitary flexible water repellent cover assembly of durable lightweight construction for covering a tall folded umbrella or other vertically elongate article and which may be manufactured at low cost. It is a further aim of the invention to provide an improved cover assembly which includes an integral means for stiffening the flexible cover to enable positioning of the cover on a vertically elongate article while enabling the cover to be readily folded into a compact package for storage when not in use.

SUMMARY OF THE INVENTION

In accordance with the invention a cover assembly for a vertically elongate article comprises a longitudinally elongate tubular cover formed from flexible water resistant sheet material and having closed end and an open end. A slit extends in a longitudinal direction along one side of the cover from the open end toward the closed end and terminates in spaced relation to the closed end. Stiffening means mounted in the cover imparts longitudinal rigid to a slit defining portion of the cover to enable the cover to be elevated to and placed in an article receiving position wherein the upper end of the slit is disposed above the upper end of the article while permitting the cover with the stiffening means therein to be folded transversely of the slit and to a compact storage condition when not in use.

DETAILED DESCRIPTION OF PREFERRED EMBODIMENTS

Figure 1:
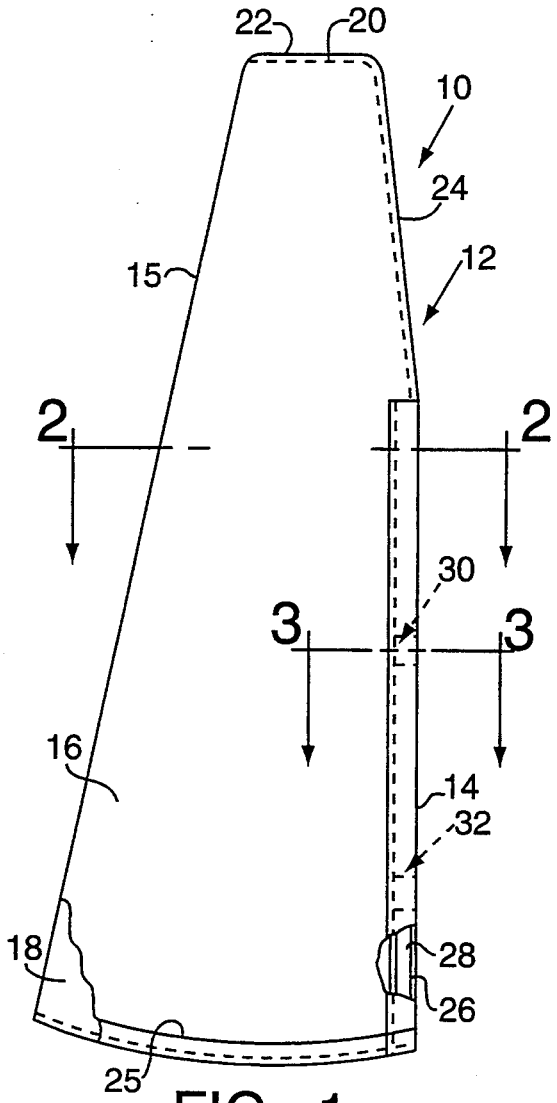
FIG. 1 is a side elevational view of an umbrella cover assembly embodying the present invention.

Turning now to the drawing the invention is illustrated and described with reference to an umbrella cover assembly indicated generally by the reference numeral 10. The illustrated cover assembly 10 essentially comprises an elongate flexible tubular cover, designated generally by the numeral 12, and at least one elongate stiffening member 28, which is used in positioning the cover on a tall article such as a folded umbrella, indicated by the letter U (FIG. 6), while allowing the cover to be folded and rolled into a compact storage position when not in use.

As illustrated in the drawings, the cover 12 has a truncated conical configuration and diverges from its upper end toward its lower end. It is preferably formed from a single sheet of lightweight water repellent flexible sheet material folded onto itself along a fold line 15 and defined by a pair of substantially identical trapezoidal panel 16 and 18 disposed in generally face-to-face relation to each other and shown in FIG. 1. The upper ends of the panels 16 and 18 are supersonically welded together or otherwise joined by any suitable means along a line of attachment 20 which extends across the cover from the fold line 14 to define the closed upper end or apex portion of the cover indicated at 22. The two panels 16 and 18 are further joined to each other along another line of attachment 24 located generally opposite the fold line 15. The line of attachment 24 extends downwardly from the line of attachment 20 and terminates at the upper end of the slit 14, substantially as shown in FIG. 1. The lower open end of the cover is preferably finished by a hem indicated at 25 in FIG. 1.

Figure 3:
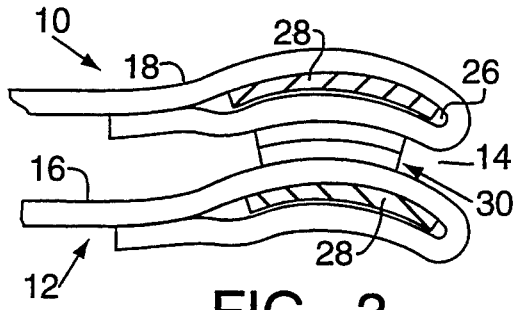
FIG. 3 is a somewhat enlarged fragmentary sectional view taken along the line 3—3 of FIG. 1.
Figure 2:
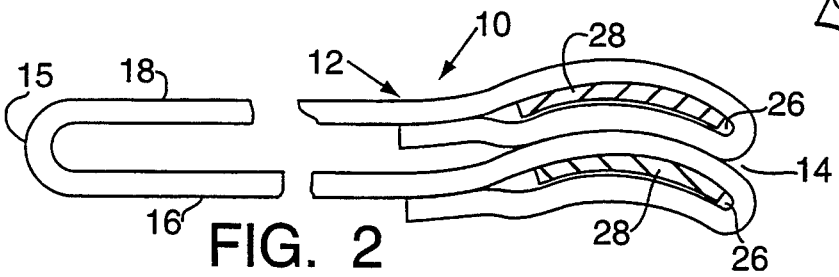
FIG. 2 is a somewhat enlarged fragmentary sectional view taken along the line 2—2 of FIG. 1.

In accordance with the presently preferred construction the slit 14 is defined by a pair of elongate pockets 26, 26. Each pocket is formed in an associated one of the panels 16 and 18, opens through the lower end of the cover 12 and forms a junction with the lower end of the line of attachment 24. Each pocket 26 is preferably formed by folding a marginal portion of an associated panel onto itself and joining it to the panel along an associated line of attachment, as best shown in FIGS. 2 and 3.

Figure 4:
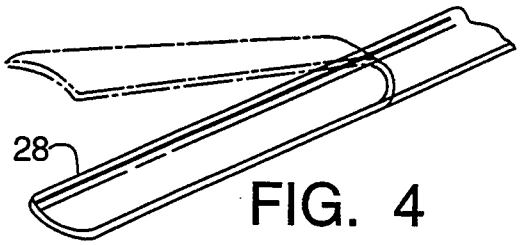
FIG. 4 is a somewhat enlarged fragmentary perspective view of a stiffening member, a folded position of the member being shown in broken lines.

The illustrated cover assembly 10 includes a pair of elongate stiffening members or battens 28, 28 which resemble the slats found in lightweight venetian blinds. The battens are made from relatively thin flexible metal or plastic of substantially uniform thickness and have an arcuate or concavo-convex cross-sectional configuration. Each batten 28 has a reasonable degree of longitudinal stiffness or rigidity, but may be readily bent in one direction about a transverse axis of flexure, that is an axis normal to the longitudinal axis of the batten. More specifically, each batten bends or flexes freely about a transverse axis and in a direction toward the center of cross-sectional curvature as shown in FIG. 4 and hereinafter refereed to as the concave direction. Each batten has a greater resistance to transverse bending in an opposite direction, that is a direction away from the center of cross-sectional curvature.

The arrangement for mounting the battens 28, 28 on or affixing the battens to the cover may vary and any suitable mounting means may be employed. However, in accordance with presently preferred practice the battens are contained within the pockets 26, 26 with the arcuate cross-sections of the battens in substantially complementary relation to each other, as shown in FIGS. 2 and 3.

Figure 7:
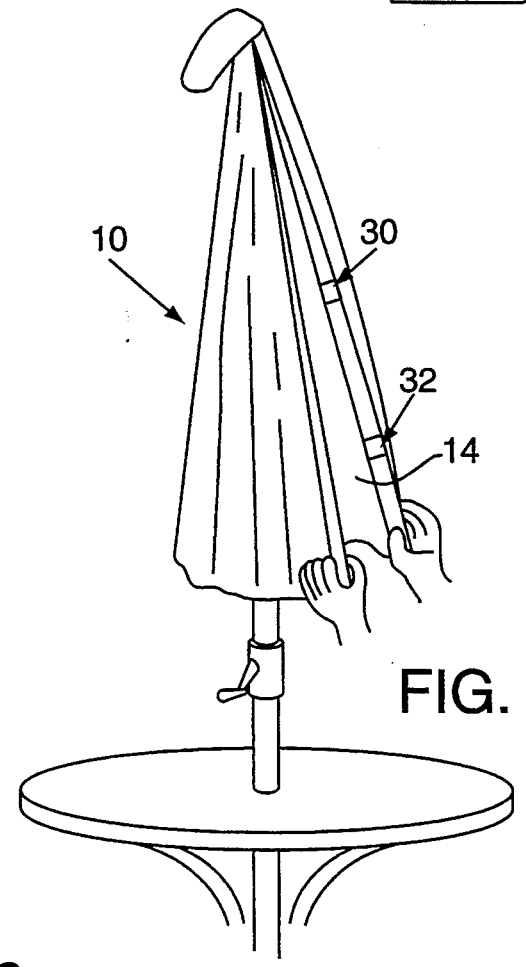
FIG. 7 is a perspective view showing the cover assembly being drawn down over the umbrella.

The battens 28, 28 impart longitudinal rigid to the flexible cover in the region of the slit 14 and aid in opening and closing the slit as will be hereinafter further discussed. Preferably, the assembly 10 includes a fastening means for releasably retaining the slit in closed condition, wherein the pockets 26, 26, with the battens 28, 28 therein are secured in substantially overlapping relation to each other, as best shown in FIG. 2. Hook and loop fasteners are presently preferred for this purpose and comprise opposing mating patches of VELCRO or a like material attached to the opposing inner surfaces of the pockets 26, 26 at longitudinally spaced apart locations and indicated generally at 30 and 32 and best shown in FIGS. 1, 3 and 7.

Figure 8:
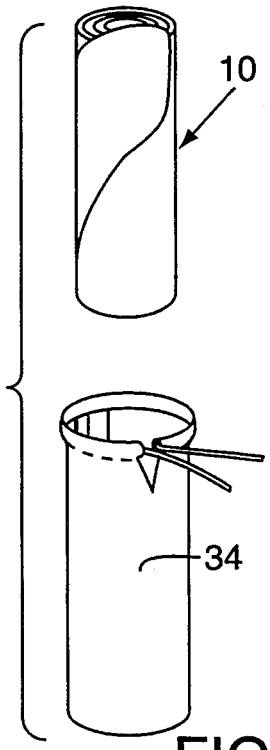
FIG. 8 is an exploded perspective view of the cover assembly of FIG. 1 shown in a folded condition and a pouch for receiving the folded cover assembly.

The cover assembly 10 is stored in a folded and rolled condition in a container or flexible pouch 34 as generally illustrated in FIG. 8. Preparatory to covering a collapsed or folded umbrella, such as the umbrella U shown supported by a table in FIG. 6, the cover assembly 10 is removed from the pouch 34 and unrolled and unfolded. As the cover assembly is unfolded the stiffening members or battens 28, 28 will usually automatically unfold. When the cover has been unfolded the hook and loop fasteners 30 and 32 are disengaged by running a hand up the slit 14.

Figure 5:
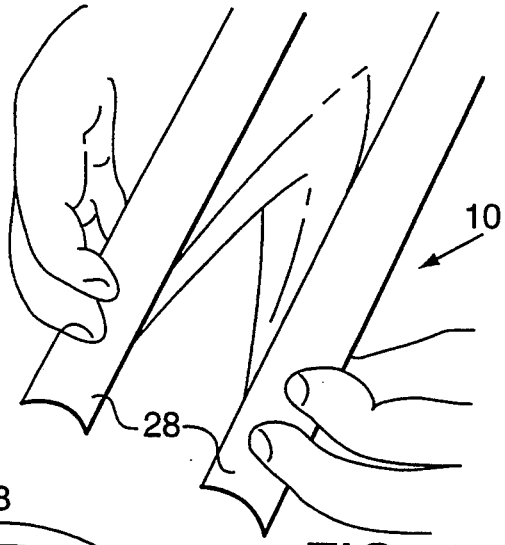
FIG. 5 is a fragmentary perspective view illustrating the manner in which the slit is opened in preparation for positioning the cover assembly on a folded umbrella.
Figure 6:
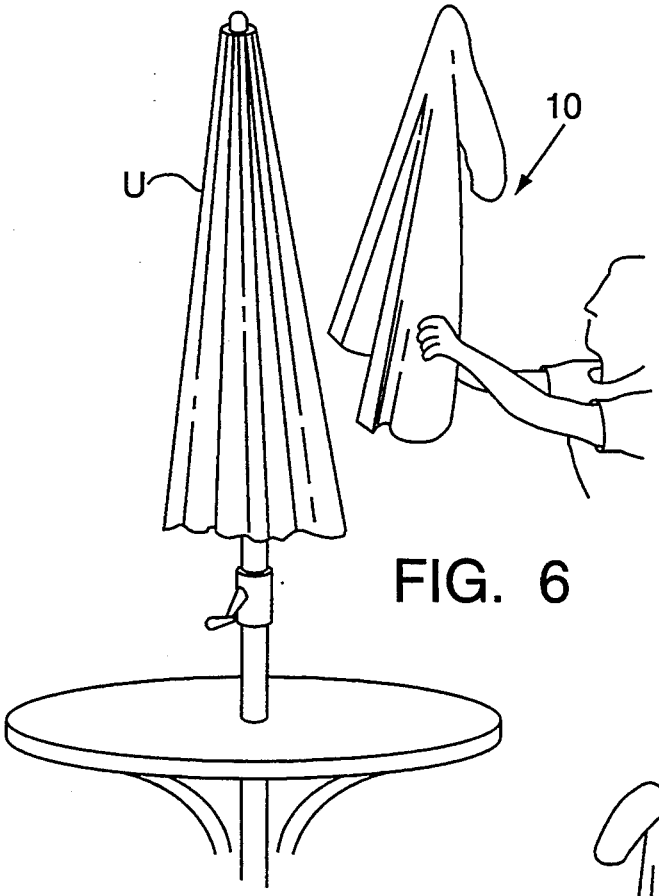
FIG. 6 is a perspective view showing the manner in which a cover assembly embodying the present invention is positioned on an umbrella.

The cover assembly 10 is placed on the table with the concave or cupped shaped side of the stiffening members 28, 28 facing upward. The top or apex portion of the cover 12 above the stiffening members 28, 28 is folded back away from the stiffener side of the cover assembly. Grasping each stiffening member at its lower end, as shown in FIG. 5, the lower ends of the stiffening member are pulled away from each other about 18 to 24 inches forming an inverted V-shaped opening in the cover. The cover is now gently lifted, as shown in FIG. 6, until the upper end of the slit is over the top of the umbrella U. During the lifting operation the cup shaped or concave sides of the stiffening members 28, 28 should be facing in the direction of the umbrella and the stiffening members should be tipped or inclined upwardly and away from the umbrella. When the cover assembly is aligned with the umbrella the cover assembly is drawn down over the umbrella and to its covering position. After the cover assembly is in place the stiffening members 28, 28 are brought into overlapping relation and the VELCRO fasteners joined to complete the covering operation.

The cover is removed from the umbrella by sliding one hand up the slit 14 to disengage the VELCRO fasteners 30 and 32. The lower ends of the stiffening members 28, 28 are grasped and the cover 12 is lifted over the top and off the umbrella. After the cover has been removed the stiffening members are brought together in overlapping relation and the VELCRO fasteners are resecured.

The cover assembly 10 is prepared for storage by holding it in a vertically oriented position. The upper end of the cover 12 is folded downward over the concave or cupped sides of the stiffening members 28, 28. The folding operation is repeated folding the upper one third of the stiffening members 28, 28 downward in the concave direction and over the cupped shaped lower portions of the stiffening members. The folding operation is repeated until the stiffening members have been folded into thirds. The wrinkles are smoothed from the extending portion of the folded cover 12 which is then rolled around the portion of the cover containing the folded stiffeners. The folded and rolled cover assembly package is then inserted into the pouch 34, shown in FIG. 8, which retains the cover in its storage condition. The pouch 34 may be stored within the confines of the umbrella ribs or may be tied or otherwise secured to the frame of another piece of lawn furniture in an inconspicuous location until it is to be used.

Figure 9:
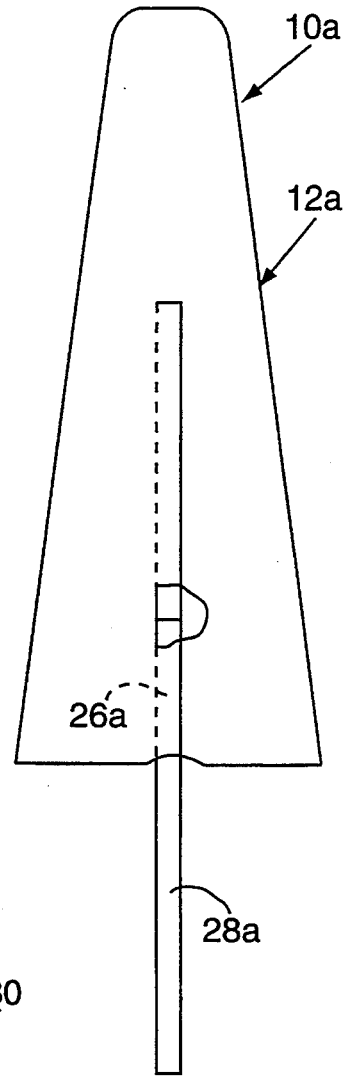
FIG. 9 is a side elevational view of another cover assembly embodying the invention.

Referring now to FIG. 9, another cover assembly embodying the invention is indicated generally at **10*a*. The illustrated cover assembly 10*a* includes a cover indicated generally at 12*a* and an elongate member 28*a***.

The cover **12*a* is made from light weight water repellent sheet material, has a truncated conical configuration and closed at its upper end and open at its lower end. A pocket 26*a* on the cover 12*a* extends longitudinally of the cover for receiving and containing the member 28*a***.

The elongate member **28*a* is similar in most respects to the stiffening member 28 previously described. However, the member 28*a* preferably connected to the cover 12*a* and is arranged to slide relative to the pocket 26*a* between an inactive position wherein it is wholly disposed within the pocket and an active or extended position shown in FIG. 9**, wherein it extends a substantial distance from the pocket and below the cover.

The member **28*a* is positioned in the pocket with the concave surface of the member facing inward or toward the interior of the cover 12*a*. In its extended position the member 28*a* serves as an extension of the cover 12*a* for use in lifting the open bottom end of the cover over the top of an umbrella or other article to be covered. When the cover is in position relative to the article to be covered the member 28*a* is pulled downward to draw the cover 12*a* to a covering position in which it enshrouds the article. The member 28a is then slid into the pocket 26a** for storage.

To remove the cover assembly 28a from an associated article the member 28a is pulled out of the pocket 26a and used to push the cover up over and off of the article.

The cover assembly 10a is stored with the member 28a in its associated pocket 26a. When the cover 12a is folded for storage the member 28a is folded to approximately one third of its extended length. After folding the cover it is rolled about the folded member 28a. The resulting package is inserted into an associated pouch, as previously described.

I claim:

1. A cover assembly for a vertically elongate article and comprising a longitudinally elongate tubular cover formed from flexible water resistant sheet material and having a closed end and an open end, said cover having a slit extending in longitudinal direction from said open end toward said closed end and terminating in spaced relation to said closed end, and stiffening means mounted on said cover for imparting longitudinal rigidity to a portion of said cover defining said slit while permitting said cover to be folded along a fold line extending transversely of said slit and to a storage condition, said cover in said storage condition having a longitudinal dimension substantially smaller than the longitudinal dimension of said slit.

2. A cover assembly as set forth in claim 1 wherein said stiffening means comprises an elongate stiffening member made from resilient flexible material and characterized by stiffness in a longitudinal direction and flexibility in a transverse direction.

3. A cover assembly as set forth in claim 2 wherein said stiffening member comprises a batten having a substantially uniform thickness and an arcuate transverse cross-sectional configuration.

4. A cover assembly as set forth in claim 3 wherein said cross-sectional configuration is concavo-convex.

5. A cover assembly as set forth in claim 2 wherein said cover defines a longitudinally extending pocket and said stiffening member is mounted in said pocket.

6. A cover assembly as set forth in claim 5 wherein said pocket is disposed adjacent said slit.

7. A cover assembly as set forth in claim 1 wherein said slit has an open condition wherein the terminal ends of said slit at said open end are spread apart and a closed condition wherein said terminal ends are adjacent to each other and said cover assembly includes fastening means for releasably retaining said slit in said closed condition.

8. A cover assembly as set forth in claim 7 wherein said retaining means comprises hook and loop fasteners.

9. A cover assembly as set forth in claim 1 wherein said stiffening means comprises a plurality of elongate stiffening members and said cover has a plurality of longitudinally extending pockets equal in number to said stiffening members and each of said stiffening members is disposed within an associated one of said pockets.

10. A cover assembly as set forth in claim 9 wherein said pockets are disposed adjacent opposite sides of said slit.

11. A cover assembly as set forth in claim 10 wherein each of said elongate stiffening members is characterized by longitudinal rigidity and flexibility in one transverse direction.

12. A cover assembly as set forth in claim 1 wherein said tubular cover diverges from said closed end to said open end.

13. A cover assembly as set forth in claim 1 including securing means for maintaining said cover and said stiffening means in said storage condition.

14. A cover assembly as set forth in claim 13 wherein said securing means comprises a pouch for receiving said cover and said stifferLing means in said storage condition therein.

15. A cover assembly as set forth in claim 14 wherein said pouch comprises a flexible tubular sleeve closed at one end and having an opening at is other end.

16. An umbrella cover assembly comprising a longitudinal elongate tubular cover formed from flexible water resistant sheet material and having a closed end and an open end, said cover having a slit extending in a longitudinal direction from said open end toward said closed end and terminating in spaced relation to said closed end, said slit having an open position wherein the terminal ends of said slit at said open end are spread apart and a closed position wherein said terminal ends are disposed adjacent each other, retaining means for releasably retaining said slit in said closed position, and stiffening means for imparting longitudinal rigidity to a lower portion of said cover and permitting transverse flexure of the portions of said cover defining said slit and including a pair of resilient longitudinally elongate stiffening members characterized by stiffness in a longitudinal direction and flexibility in a transverse direction, said cover and said stiffening means being foldable transversely of said slit and to a storage condition, said cover in said storage condition having a longitudinal dimension substantially smaller than the longitudinal dimension of said slit.

17. An umbrella cover assembly as set forth in claim 16 including securing means for maintaining said cover and said stiffening means in said storage condition.

18. An umbrella cover assembly as set forth in claim 17 wherein said securing means comprises a container for receiving said cover and said stiffening means in said storage condition.

19. An umbrella cover assembly as set forth in claim 18 wherein said container comprises a flexible tubular pouch.

20. An umbrella cover assembly as set forth in claim 19 including attaching means carried by said pouch for releasably securing said pouch to another article.

21. An umbrella cover assembly for a vertically elongate article and comprising a longitudinally elongate tubular cover formed from flexible water resistant sheet material and having a closed end and an open end, said cover having a longitudinally extending pocket, and a longitudinally elongate member received within and extending longitudinally of said pocket, said elongate member made from resilient flexible material and having an arcuate transverse cross section, said elongate member characterized by longitudinal rigidity, resilient free flexure about transverse axes of flexure and in a direction toward the center of cross sectional curvature and resistance to transverse flexure in a direction away from said axis of cross sectional curvature, said elongate member and said cover being transversely foldable to form a package having a longitudinal dimension less than the longitudinal dimension of said elongate member.

* * * * *